US006166692A

United States Patent [19]

Nalbandian et al.

[11] Patent Number: 6,166,692

[45] Date of Patent: Dec. 26, 2000

[54] PLANAR SINGLE FEED CIRCULARLY POLARIZED MICROSTRIP ANTENNA WITH ENHANCED BANDWIDTH

[75] Inventors: Vahakn Nalbandian, Ocean, N.J.; Choon Sae Lee, Dallas, Tex.

[73] Assignee: The United States of America as represented by the Secretary of the Army, Washington, D.C.

[21] Appl. No.: 09/280,877

[22] Filed: Mar. 29, 1999

[51] Int. Cl.[7] ..... H01Q 1/38

[52] U.S. Cl. ..... 343/700 MS; 343/770; 343/829

[58] Field of Search ..... 343/700 MS, 846, 343/767, 770, 829, 830; H01Q 1/38

[56] References Cited

U.S. PATENT DOCUMENTS

| | | | |
|---|---|---|---|
| 5,003,318 | 3/1991 | Berneking et al. | 343/700 MS |
| 5,382,959 | 1/1995 | Pett et al. | 343/700 MS |
| 5,408,241 | 4/1995 | Shattuck, Jr. et al. | 343/700 MS |
| 5,646,634 | 7/1997 | Bokhari et al. | 343/700 MS |
| 5,703,601 | 12/1997 | Nalbandian et al. | 343/700 MS |

*Primary Examiner*—Hoanganh Le
*Assistant Examiner*—Hoang Nguyen
*Attorney, Agent, or Firm*—Michael Zelenka; George B. Tereschuk

[57] ABSTRACT

A microstrip antenna providing circularly polarized radiation formed by two layered cavities with two rectangular conductive patches. A first cavity is formed by a ground plane and a first rectangular conductive patch having a lateral dimension and coupling holes placed therein. A second cavity is formed between the first rectangular conductive path and a second rectangular conductive patch having a longitudinal dimension. The longitudinal dimension of the second rectangular conductive patch is essentially equal to the lateral dimension of the first rectangular conductive patch. The second rectangular conductive patch is coupled through the coupling holes to the first rectangular conductive patch, resulting in circularly polarized radiation. The circularly polarized antenna can easily be manufactured using conventional microstrip techniques. Additionally, bandwidth and power are improved. The antenna has many applications, including military and commercial communication systems, aircraft antennas and global positioning system receivers.

13 Claims, 4 Drawing Sheets

PLANAR SINGLE FEED CIRCULARLY POLARIZED MICROSTRIP ANTENNA WITH ENHANCED BANDWIDTH

GOVERNMENT INTEREST

The invention described herein may be manufactured, used, sold, or licensed by or for the Government of the United States of America without payment to us of any royalty thereon.

FIELD OF THE INVENTION

The present invention relates generally to antennas for use in the UHF, microwave frequencies, or millimeter wave frequencies, and more particularly to a circularly polarized antenna with an enhanced bandwidth.

BACKGROUND OF THE INVENTION

Circularly polarized antennas are often desirable in many applications using UHF, microwave frequencies, and millimeter wave frequencies. A circularly polarized wave may be produced by radiating horizontally and vertically polarized waves ninety degrees out of phase. This is often accomplished with power dividers and ninety degrees phase shifters. However, these power divider and phase shifter components often complicated the design of circularly polarized antennas. Additionally, the extremely narrow bandwidth of prior circularly polarized anternas make them undesirable in most applications requiring moderate bandwidth. Many systems, such as military and commercial communications systems, could be improved with compact, low cost, rugged, conformable antennas. Such antennas could readily be utilized in aircraft and global positioning system receivers. Microstrip antenna fabrication techniques are preferably used because of the lighter weight, lower cost, and low profile construction. However, most prior microstrip antenna designs have been limited because of narrow bandwidths limiting their practical applications. In particular, circularly polarized bandwidth has been extremely narrow. This is especially applicable to a single feed microstrip antennas. One such circularly polarized antenna that is of a modified microstrip design is disclosed in U.S. Pat. No. 5,703,601 entitled "Double Layer Circularly Polarized Antenna With Single Feed" issuing to Nalbandian et al on Dec. 30, 1997, which is herein incorporated by reference. Therein disclosed is a circularly polarized antenna having spaced square conductive patches with opposing side walls. The opposing side walls of each patch are perpendicular with respect to each other. While this antenna design has many advantages, it is difficult to manufacture due to the opposing side walls, which are perpendicular to the plane of the patches. Additionally, the bandwidth is relatively narrow, limiting its application. Accordingly, there is a need for an improved microstrip antenna that can be easily manufactured, having no vertical or perpendicular side walls and improved bandwidth.

SUMMARY OF THE INVENTION

The present invention is a circularly polarized microstrip antenna that may be easily manufactured and has a relatively wide bandwidth. A first cavity is formed between a ground plane and a first rectangular conductive patch in a plane substantially parallel to the ground plane, the first rectangular conductive patch having apertures along a diagonal thereof. A second rectangular conductive patch is positioned over the first rectangular conductive patch forming a second cavity therebetween. The second rectangular conductive patch being smaller than the first rectangular conductive patch with a longitudinal dimension of the second rectangular conductive patch being equal to a lateral dimension of the first rectangular conductive patch. The first rectangular conductive patch is fed by a transmission line with the second rectangular conductive patch coupled thereto through the apertures in the first rectangular conductive patch.

Accordingly, it is an object of the present invention to provide a circularly polarized microstrip antenna that is easily manufactured at relatively low cost.

It is a further object of the present invention to improve performance of a circularly polarized antenna.

It is an advantage of the present invention that it has a relatively wide bandwidth with increased power.

It is a further advantage of the present invention that the axial ratio away from the bore sight is improved.

It is a feature of the present invention that the length of the sides of the conductive patches are different, with the length of one side of the rectangular conductive patches being equal.

It is another feature of the present invention that the top cavity is thicker than the lower cavity.

These and other objects, advantages, and features will be readily apparent in view of the following detailed description.

DETAILED DESCRIPTION OF THE PREFERRED EMBODIMENTS

Figure 1:
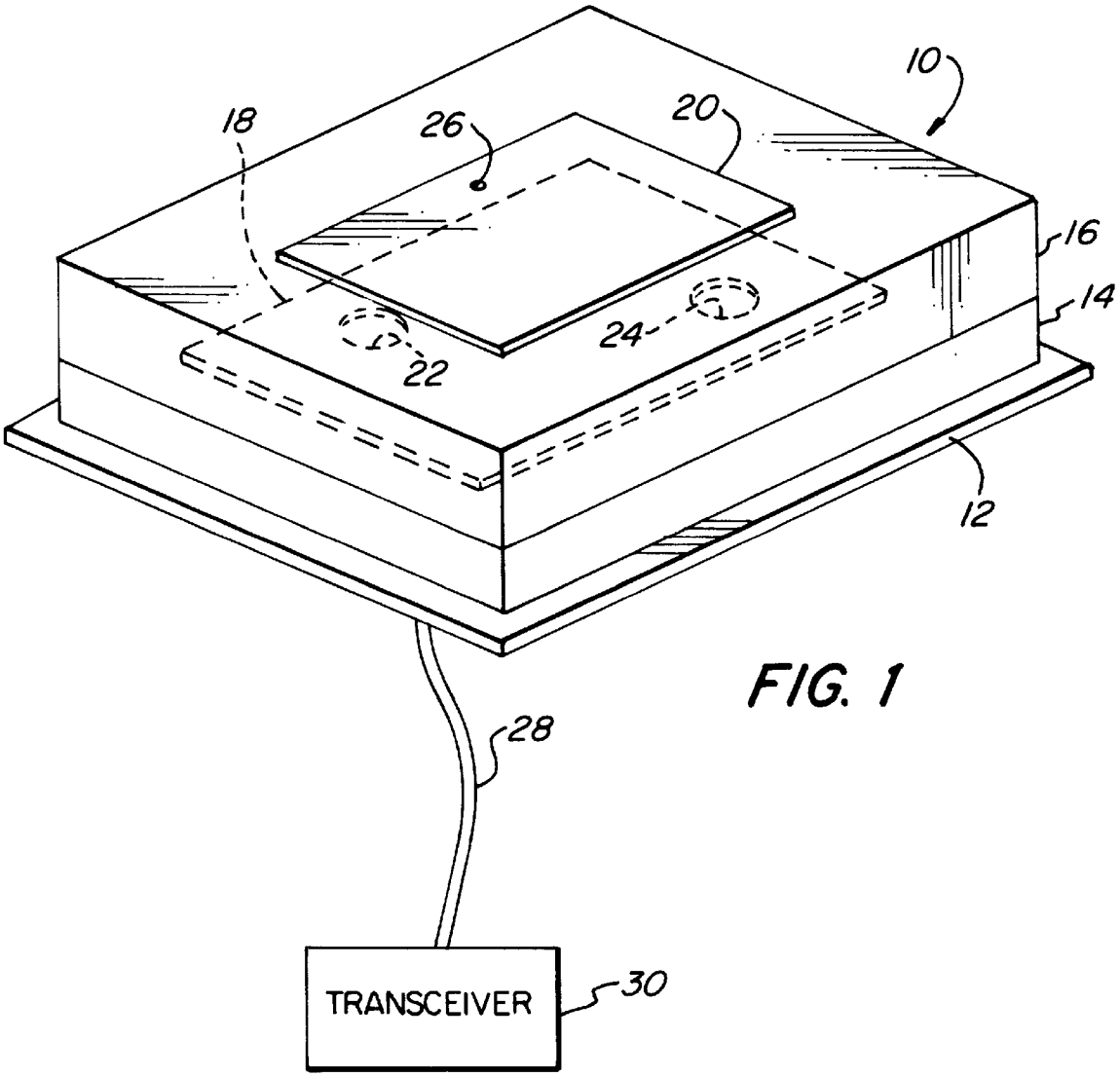
FIG. 1 is a schematic perspective view of the circularly polarized microstrip antenna of the present invention.

FIG. 1 is a perspective schematic view illustrating the circularly polarized microstrip antenna 10 of the present invention. A first dielectric substrate 14 is placed on a conductive ground plane 12. Substrate 14 may be made of any dielectric material such as DUROID. Placed on the first dielectric substrate 14 is a middle or first rectangular conductive patch 18. The conductive patch 18 may be made out of any conductive material, and preferably copper. Placed on top of the middle or first rectangular conductive patch 18 is a second dielectric substrate 16. The middle or first rectangular conductive patch 18 has a plurality of circular apertures 22 and 24 centered on a diagonal of the rectangular conductive patch 18. Preferably, the circular apertures 22 and 24 are positioned midway between the center of the diagonal and a corner of the conductive patch 18. A second rectangular conductive patch 20 is positioned over the first rectangular conductive patch 18 such that the plurality of circular apertures 22 and 24 are within the perimeter of the second rectangular conductive patch 20. The longitudinal dimension or length of the second rectangular conductive patch 20 is substantially equal to the lateral dimension or width of the first rectangular conductive patch 18. A central conductor 26 of a coaxial feed is connected to the bottom surface of the second rectangular conductive patch 20 and the first rectangular conductive patch 18. A coaxial feed 28 is coupled to the ground plane 12 and feeds the first rectangular conductive patch 18. Transceiver 30 is coupled to the coaxial feed 28 providing a signal to be transmitted or received by the circularly polarized antenna 10.

Figure 2:
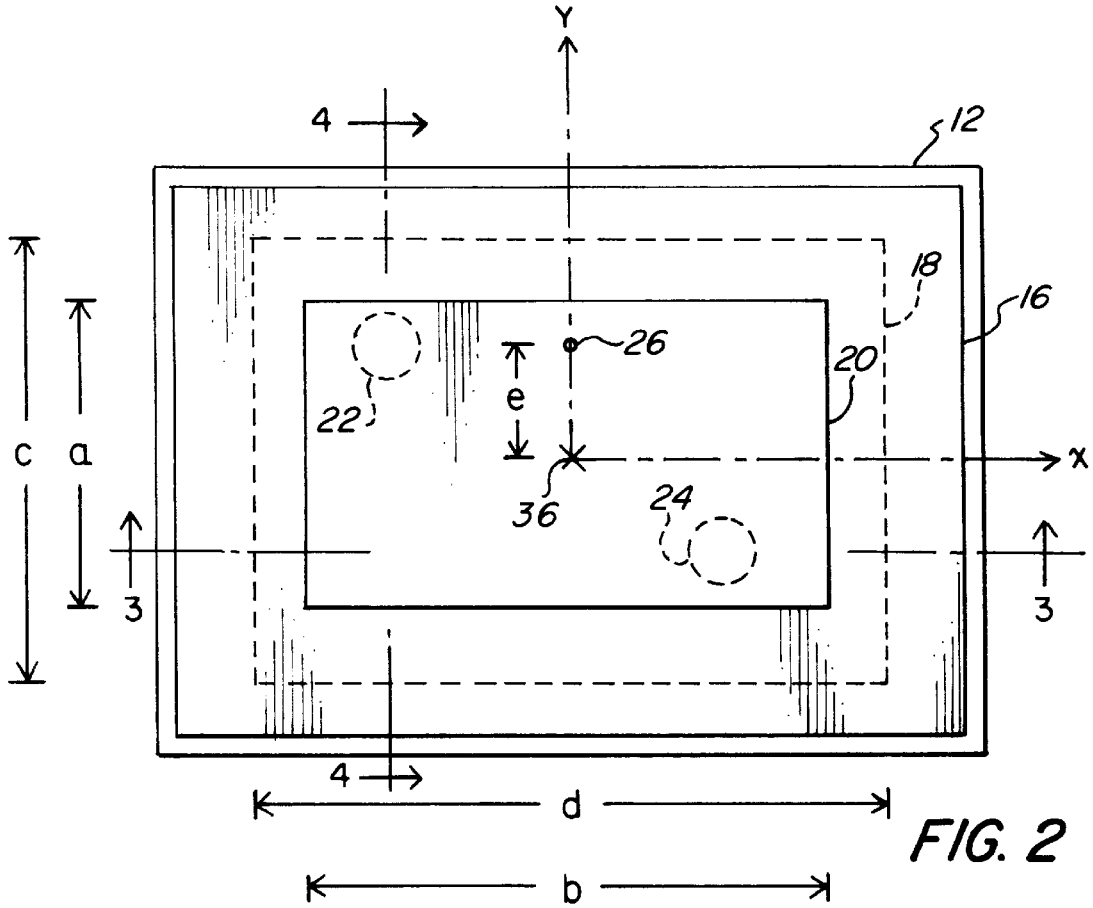
FIG. 2 is a plan view of the present invention.

FIG. 2 is a plan view illustrating the relationship of the dimensions of the first and second rectangular conductive patches 18 and 20. A reference axis X-Y is illustrated at center 36 of the second rectangular conductive patch 20. Dimension a illustrates the lateral dimension or width of the second rectangular conductive patch 20. The dimension b represents the longitudinal dimension or length of the second rectangular conductive patch 20. Dimension c represents the lateral dimension or width of the first rectangular conductive patch 18. Dimension d represents the longitudinal dimension or length of the first rectangular conductive patch 18. The dimensions of the first and second rectangular conductive patches 18 and 20 are selected such that a lateral dimension or width of the first rectangular conductive patch 18 is substantially equal to a longitudinal dimension or length of the second rectangular conductive patch 20. That is, dimension c is equal to dimension b. Dimension e represents the distance from center 36 to the central conductor 26 of a feed.

Figure 3:
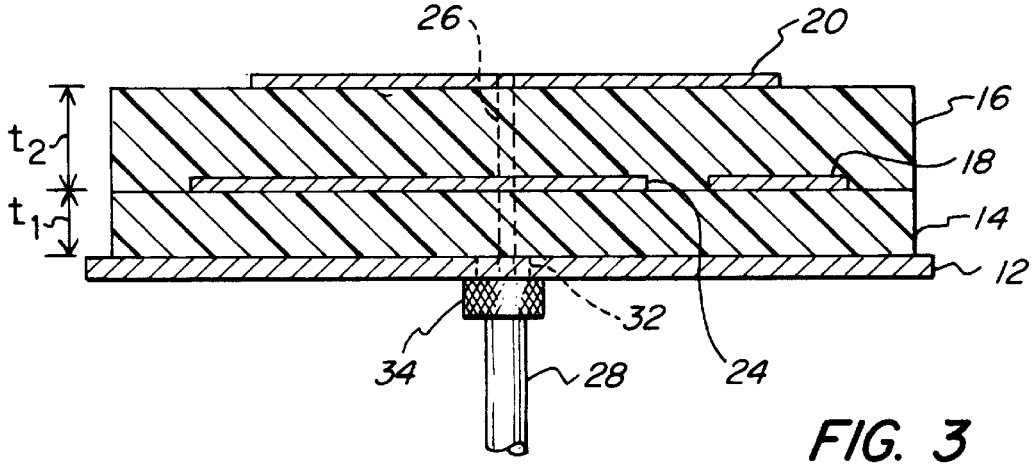
FIG. 3 is a cross section taken along line 3—3 in FIG. 2.

FIG. 3 is a longitudinal cross section taken along line 3—3 in FIG. 2. FIG. 3 more clearly illustrates the spacing of the ground plane 12, the middle or first rectangular conductive patch 18, and the upper or second rectangular conductive patch 20. Hole or aperture 24 formed within the first rectangular conductive patch 18 is also more clearly illustrated. FIG. 3 also more clearly illustrates the connection of the central conductor 26. The central conductor 26 of coaxial feed 28 is connected to the first rectangular conductive patch 18 and the second rectangular conductive patch 20. The connection of the central conductor 26 between the first rectangular conductive patch 18 and the second rectangular conductive patch 20 acts as a shunt. The coaxial feed 28 is connected to the ground plane 12 by conventional means, such as a connector or coupler 34. The outer sheath 32 of the coaxial feed 28 is connected to the ground plane 12. The thickness of the first dielectric substrate 14 is illustrated as $T_1$ and the thickness of the second dielectric substrate 16 is illustrated as $T_2$. Preferably, $T_2$ is greater than $T_1$.

Figure 4:
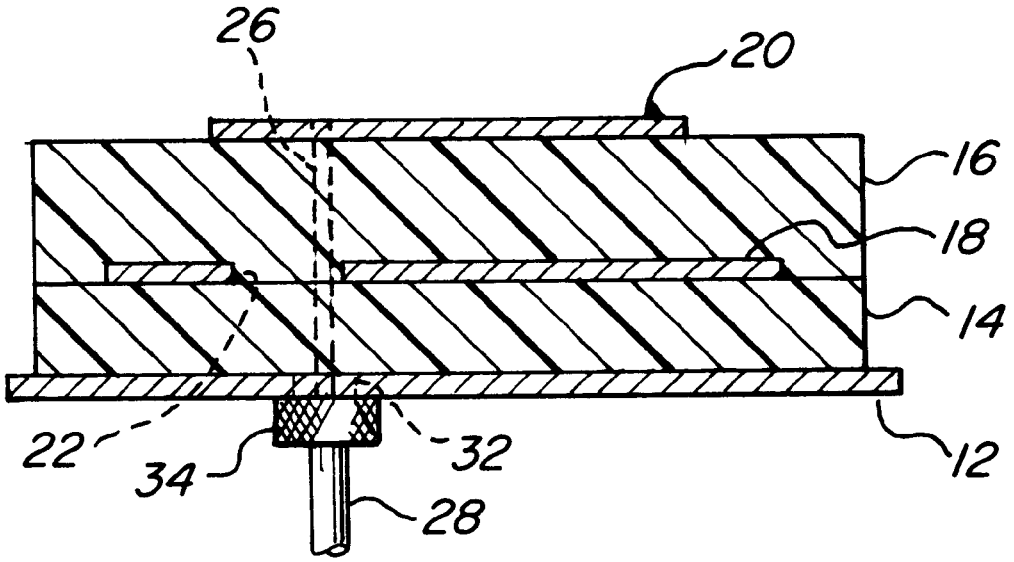
FIG. 4 is a cross section taken along line 4—4 in FIG. 2.

FIG. 4 is a lateral cross section taken along Line 4—4 in FIG. 2. The circular hole or aperture 22 is more clearly illustrated in FIG. 4.

The operation of the present invention can readily be appreciated with reference to FIGS. 1–4. The theoretical model used in the present invention is based on the cavity model. In order to produce circularly polarized radiation, the antenna should be excited such that the fields in the two cavities are perpendicular to each other and have equal magnitudes and a phase difference of ninety degrees. For the ninety degree phase shift, the lower cavity is excited by a coaxial feed 28 while the upper cavity is fed by coupling through the circular holes or apertures 22 and 24 in the middle or first conductive rectangular patch 18. If the holes or apertures 22 and 24 are small, the device will provide field excitations in the two cavities that are ninety degrees out of phase. However, the holes or coupling apertures 22 and 24 should be large enough to insure equal field amplitudes in the upper and lower resonance cavities. The appropriate sized aperture can readily be determined without any undue experimentation. To achieve circularly polarized radiation, it is also required that the field radiated from the lower layer should be perpendicular to the field radiated from the upper layer. To achieve this in the present invention, the lengths of the radiating edges of the upper and lower cavities are made to be different so that the unwanted modes will not be excited. However, to insure circularly polarized radiation at the resonant frequency, the length of the radiating edges of the lower layer is approximately equal to the one of the upper layer. As illustrated in FIG. 2, dimension b is approximately equal to dimension c. In order to compensate for the reduced radiation in the upper cavity due to the shortened radiating edges, the layer thickness of the upper layer is increased appropriately. Therefore, as illustrated in FIG. 3, the thickness $T_2$ of the second dielectric substrate 16 is greater than the thickness $T_1$ of the lower or first dielectric substrate 14.

The feed pin or central conductor 26 passes through the middle or first rectangular conductive patch 18 and is attached or coupled to the top or second rectangular conductive patch 20 to suppress any unwanted mode excitation in the upper cavity. The feed pin or central conductor 26 in this case is in contact with both the middle or first rectangular conductive patch 18 and the upper or second rectangular conductive patch 20, thus acting as feed for the lower cavity and as a local short for the upper cavity. This arrangement also facilitates the fabrication process. Dimension e in FIG. 2 may be modified or changed in the Y direction to match impedance.

The present invention has many advantages over prior circularly polarized antennas. The frequency for the axial ratio, the ratio of the major axis to the minor axis of the polarization ellipse of a waveguide, is nearly the same as the antenna resonant frequency for the least input VSWR, voltage standing wave ratio, independent of the Q value, providing more power for radiation and wider circularly polarized bandwidth. The circularly polarized characteristics are almost independent of the feed location providing a simple design procedure. Theoretically, a perfect circularly polarized radiation is realizable without the input impedance mismatched. Accordingly, the present invention is more easily manufactured at a reduced cost while providing improved quality over the entire radiation zone. The present invention is also particularly well adapted to use in microwave millimeter wave integrated circuits, MMIC, and may be relatively easily manufactured using conventional integrated circuit fabrication techniques.

An embodiment of the present invention that has actually been reduced to practice and tested had the following dimensions, with reference to FIG. 2. Dimension a=3.82 cm; dimension b=4.58 cm; dimension c=4.58 cm; and dimension d=5.59 cm. The feed pin was located 0.64 cm from the center edge of the top or second conductive patch. The radius of the coupling holes was 0.5 cm. The center of the coupling holes were located 1.32 cm in the X direction and 1.10 cm in the Y direction from the edges of the middle or first conductive rectangular patch 18. The dielectric constant of the substrates was 2.2. Referring to FIG. 3, the thickness $T_1$ of the first dielectric substrate 14 was 31 mils and the thickness $T_2$ of the second dielectric substrate 16 was 125 mils. This embodiment of the present invention resulted in a measured frequency for an optimum axial ratio of 2.098 GHz, which is almost the same as the measured resonant frequency for the least input VSWR, 2.096 GHz. In other words, the input impedance is almost perfectly matched at the frequency of the optimum axial ratio.

Figure 5:
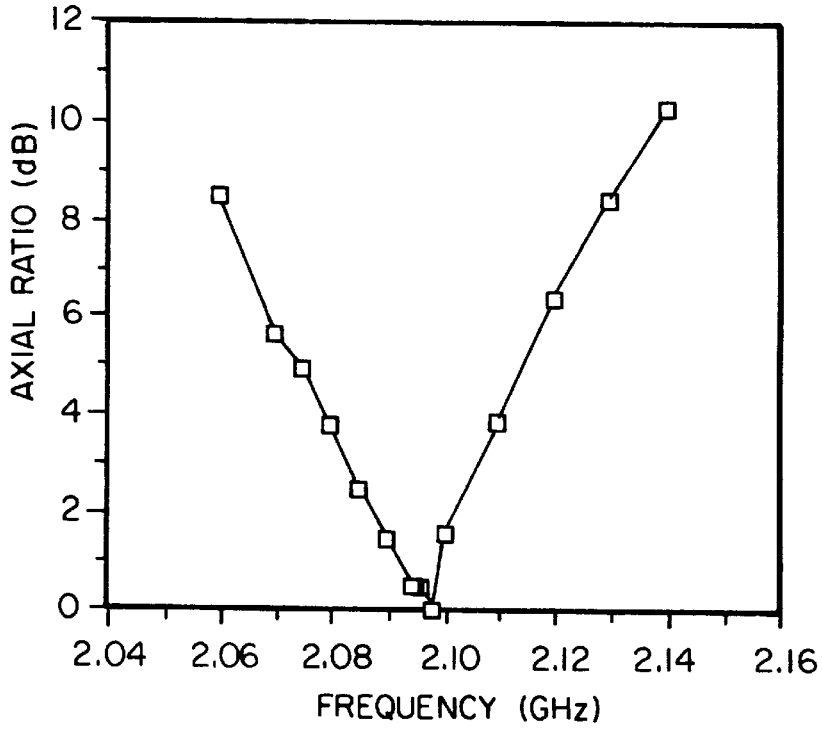
FIG. 5 is a graph illustrating the axial ratio as a function of frequency.

FIG. 5 graphically illustrates the axial ratio as a function of frequency. As can be seen from FIG. 5, the measured 6-dB circularly polarized band width is 2.5%. This is a substantial improvement over the bandwidth of prior circularly polarized microstrip type antennas having vertical side walls, which have been measured at 1.63%, and much improved over comparable circularly polarized antennas, which have a bandwidth of less than 1%.

Figure 6:
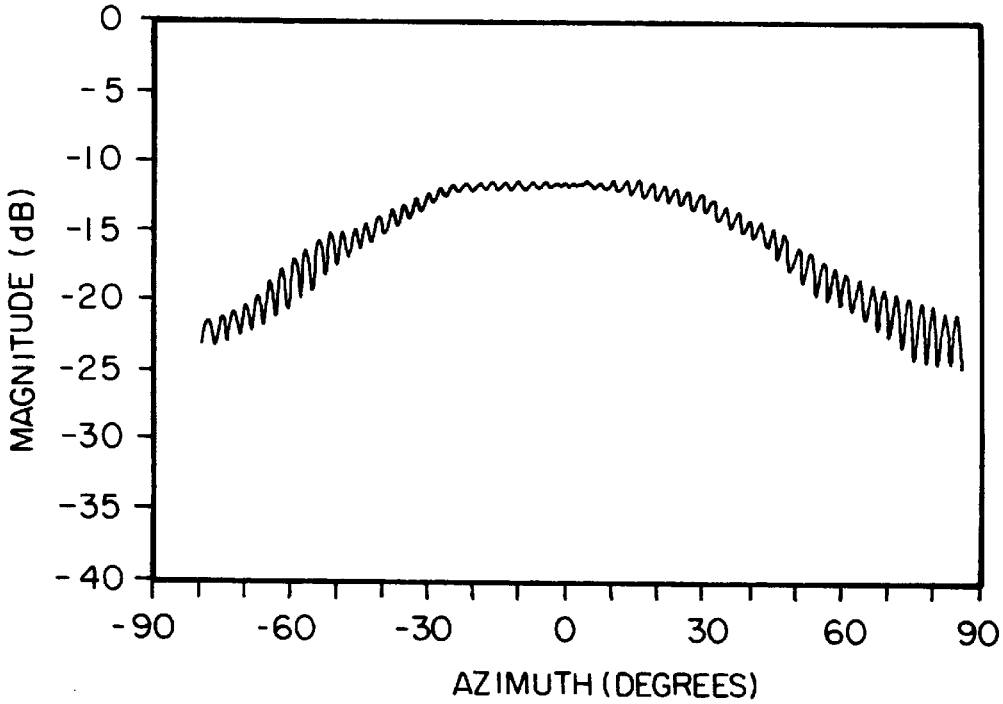
FIG. 6 is a graph illustrating the radiation pattern with magnitude as a function of azimuth angle for the present invention.

FIG. 6 graphically illustrates the radiation pattern measured with a rotating linearly polarized receiver horn. As can be seen in FIG. 6, the axial ratio remains within a few dB over most of the radiating zone.

Accordingly, the present invention has a simplified structure that results in improved performance over prior circularly polarized microstrip antennas. Therefore, the present invention advances the art by increasing performance at a reduced cost. Although the preferred embodiment has been illustrated and described, it will be obvious to those skilled in the art that various modifications may be made without departing from the spirit and scope of this invention.

What is claimed is:

1. A circularly polarized antenna comprising:

a first cavity formed between a conductive plane and a first rectangular conductive patch having a first longitudinal dimension and a first lateral dimension;

a second cavity formed between the first rectangular conductive patch and a second rectangular conductive patch having a second longitudinal dimension and a second lateral dimension, the first longitudinal dimension being different from the second longitudinal dimension and the first lateral dimension being different than the second lateral dimension;

one of the first or second longitudinal dimensions is substantially equal to one of the first or second lateral dimensions; and the first lateral dimension is substantially equal to the second longitudinal dimension.

2. A circularly polarized antenna as in claim 1, further comprising a dielectric material placed within said first and said second cavity.

3. A circularly polarized antenna as in claim 2 wherein:

the thickness of said second cavity is greater than the thickness of said first cavity;

the first lateral dimension is a first lateral width; and said second longitudinal dimension is a second longitudinal length.

4. A circularly polarized antenna as in claim 3, further comprising:

a plurality of apertures placed in the first rectangular conductive patch.

5. A circularly polarized antenna as in claim 4 wherein:

said plurality of apertures are sized to provide equal field amplitudes in said first and second cavities.

6. A circularly polarized antenna as in claim 1, further comprising:

a means for coupling, associated with said first rectangular conductive patch, for coupling said first cavity to said second cavity, whereby field excitations in the first and second cavities are ninety degrees out of phase.

7. A circularly polarized antenna as in claim 1, further comprising a transceiver coupled to said first cavity.

8. A planar circularly polarized antenna comprising:

a ground plane;

a first planar dielectric material having a first thickness placed on said ground plane;

a first rectangular conductive patch formed adjacent said first planar dielectric material forming a first cavity, said first rectangular conductive patch having a plurality of apertures and a first lateral width;

a second planar dielectric material having a second thickness placed over said first rectangular conductive patch; and a second rectangular conductive patch, placed over said second planar dielectric material, said second rectangular conductive patch having a second longitudinal length substantially equivalent to said first lateral width of said first rectangular conductive patch, with the second longitudinal length being substantially mutually perpendicular with respect to said first lateral width, whereby unwanted modes will not be excited and fields of said first cavity and said second cavity are mutually perpendicular and have a phase difference of ninety degrees causing circularly polarized electromagnetic radiation.

9. A planar circularly polarized antenna as in claim 8 wherein:

the second thickness of said second planar dielectric material is greater than the first thickness of said first planar dielectric material.

10. A planar circularly polarized antenna as in claim 9 wherein:

the second thickness is at least twice the first thickness.

11. A planar circularly polarized antenna as in claim 8 wherein:

the plurality of apertures are centered on a diagonal of said first rectangular conductive patch.

12. A planar circularly polarized antenna as in claim 8 wherein:

said first and second dielectric materials have a dielectric constant greater than two.

13. A planar microstrip circularly polarized antenna comprising:

a conductive ground plane;

a first planar rectangular dielectric material placed on said ground plane;

a first rectangular conductive patch formed adjacent said first planar dielectric material, forming a first cavity, said first rectangular conductive patch having a first longitudinal length and a first lateral width and two holes therein centered on a diagonal of said first rectangular conductive patch;

a second planar dielectric material placed over said first rectangular conductive patch; and a second rectangular conductive patch, placed over said second planar dielectric material, said second rectangular conductive patch having a second longitudinal length and a second lateral width, the second longitudinal length of said second rectangular conductive patch being substantially equal to the first lateral width of said first rectangular conductive patch; and a feed coupled to the first cavity, whereby unwanted modes will not be excited and fields of said first cavity and said second cavity are mutually perpendicular and have a phase difference of ninety degrees causing circularly polarized electromagnetic radiation.

* * * * *